US008256878B2

(12) United States Patent
Ibe et al.

(10) Patent No.: US 8,256,878 B2
(45) Date of Patent: Sep. 4, 2012

(54) SUBSTRATE FOR INK EJECTION HEADS, INK EJECTION HEAD, METHOD OF MANUFACTURING SUBSTRATE, AND METHOD OF MANUFACTURING INK EJECTION HEAD

(75) Inventors: Satoshi Ibe, Yokohama (JP); Yoshinori Tagawa, Yokohama (JP); Kazuhiro Asai, Kawasaki (JP); Hiroto Komiyama, Tokyo (JP); Toshiaki Kurosu, Kawasaki (JP); Masataka Nagai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/635,974

(22) Filed: Dec. 11, 2009

(65) Prior Publication Data

US 2010/0149280 A1 Jun. 17, 2010

(30) Foreign Application Priority Data

Dec. 15, 2008 (JP) ..... 2008-318565

(51) Int. Cl.
*B41J 2/05* (2006.01)

(52) U.S. Cl. ..... 347/63

(58) Field of Classification Search ..... 347/54, 347/56, 61, 63

See application file for complete search history.

(56) References Cited

U.S. PATENT DOCUMENTS 5,478,606 A 12/1995 Ohkuma
6,238,041 B1 * 5/2001 Hasegawa ..... 347/63
6,390,606 B1 5/2002 Terui

* cited by examiner

*Primary Examiner* — An Do
(74) *Attorney, Agent, or Firm* — Canon USA Inc. IP Division

(57) ABSTRACT

A liquid ejection head according to the present invention includes a heat-generating resistor layer, a first electrode layer, an insulating layer extending over the heat-generating resistive layers and the first electrode layer, and a second electrode layer that has a first portion which extending through the insulating layer and which is electrically connected to the first electrode layer and also has a second portion which is not in contact with the insulating layer. The second portion has a space or a piece of resin disposed between the insulating layer and the second electrode layer.

8 Claims, 10 Drawing Sheets

SUBSTRATE FOR INK EJECTION HEADS, INK EJECTION HEAD, METHOD OF MANUFACTURING SUBSTRATE, AND METHOD OF MANUFACTURING INK EJECTION HEAD

BACKGROUND OF THE INVENTION

1. Field of the Invention

The present invention relates to a substrate for ink ejection heads, an ink ejection head, a method of manufacturing the substrate, and a method of manufacturing the ink ejection head.

2. Description of the Related Art

Liquid ejection recording methods are those of performing recording in such a manner that liquids such as ink are ejected through discharge ports arranged in liquid ejection heads so as to be applied to recording media such as sheets of paper. A liquid ejection recording method in which a liquid is ejected in such a manner that the liquid is bubbled by thermal energy generated by an energy-generating element is capable of forming a high-quality image and capable of performing high-speed recording.

In general, a liquid ejection head includes a plurality of discharge ports, a passage communicatively connected to the discharge ports, and a plurality of energy-generating elements generating thermal energy used to eject ink. The energy-generating elements include heat-generating resistor layers. The heat-generating resistive layers are covered with an upper protective layer for protecting the energy-generating elements from liquids and include lower layers for storing heat.

In methods of manufacturing conventional liquid ejection heads, the distance between each heat-generating resistive element and a corresponding one of discharge ports is set with high accuracy and reproducibility such that high-quality recording can be performed.

U.S. Pat. No. 5,478,606 discloses a method of manufacturing a liquid ejection head. The method includes forming a passage pattern using a soluble resin, coating a solid with a coating resin such as an epoxy resin at room temperature, forming discharge ports, and dissolving the soluble resin.

The following method is known: a method in which a coating resin for forming a passage member is attached to a substrate in such a manner that an adhesive layer made of a polyether amide resin is placed therebetween. The substrate carries energy-generating elements used to eject ink, an insulating layer overlying the energy-generating elements, and the like. FIG. 11 is a perspective view of a liquid ejection head disclosed in U.S. Pat. No. 6,390,606. FIG. 12 is a sectional view of the liquid ejection head taken along the line XII-XII of FIG. 11. The liquid ejection head includes a substrate; an electrode interconnect 221 formed by gold plating; and, for example, a titanium-tungsten layer 220 for preventing gold from diffusing into the substrate. The titanium-tungsten layer 220 is disposed under the electrode interconnect 221 and contains a refractory metal.

The substrate is disposed under the titanium-tungsten layer 220 and includes a P—SiN layer 219, electrode layer 218, and interlayer insulating layer 217 arranged in that order. The P—SiN layer 219 is located at the top of the substrate.

The electrode interconnect 221 is overlaid with a metal layer 222 having high adhesion with an organic resin for ejecting ink.

The development of elongated substrates requires the use of electrode interconnects made of gold, which has low resistance, and causes an increase in the contact area between an electrode interconnect and a P—SiN layer located at the top of each of the elongated substrates.

In order to increase the heat efficiency of heat-generating resistors for energy saving, it is highly predictable that a P—SiN layer located at the top of each substrate needs to have a reduced thickness.

In the case of reducing the resistance of electrode interconnects for supplying electric power to heat-generating resistors in a method of manufacturing the liquid ejection head disclosed in U.S. Pat. No. 6,390,606, the electrode interconnects are preferably formed by a plating process using gold, which is a good material with low resistance. In particular, an electrode layer made of gold is preferably provided above the substrate used in the liquid ejection head.

In the case of forming electrode interconnects by a conventional electroplating process, there is a problem below.

In the conventional electroplating process, after a diffusion-preventing layer made of a refractory metal and a gold seed layer are formed over a wafer, resist patterning is performed and a gold plating layer is then formed; hence, the diffusion-preventing layer is sandwiched between the gold plating layer and the wafer.

When a substrate obtained from the wafer has surface defects such as pinholes, the substrate is probably shorted with electrode interconnects prepared from the gold plating layer.

This is probably because the elongation of the substrate leads to an increase in the length and area of each gold electrode interconnect to cause short-circuits between the substrate and the electrode interconnects.

In this case, a thick P—SiN layer is provided on the substrate so as to cover defects such as pinholes or an insulating layer is added. However, this probably causes a reduction in energy efficiency or productivity.

SUMMARY OF THE INVENTION

The present invention provides a substrate, including gold electrode interconnects, for liquid ejection heads. Layers deposited on the substrate are kept appropriate such that the substrate has increased reliability.

A substrate for liquid ejection heads according to the present invention includes an element generating energy used to eject a liquid, a first electrode layer disposed in contact with the element, an insulating layer extending over the first electrode layer and the element, and a second electrode layer that has a first portion extending through the insulating layer to the first electrode layer and a second portion positioned differently from that of the first portion in the direction perpendicular to a thickness direction of the insulating layer and which is not in contact with the insulating layer. The second portion is a space located between the second electrode layer and the insulating layer.

A substrate for liquid ejection heads according to the present invention includes an element generating energy used to eject a liquid, a first electrode layer disposed in contact with the element, an insulating layer extending over the first electrode layer and the element, and a second electrode layer that has a first portion extending through the insulating layer to the first electrode layer and a second portion positioned differently from that of the first portion in the direction perpendicular to a thickness direction of the insulating layer and which is not in contact with the insulating layer. The second portion is a piece of resin disposed between the second electrode layer and the insulating layer.

A method of manufacturing a substrate according to the present invention includes preparing a base plate including an element, a first electrode layer disposed in contact with the element, and an insulating layer extending over the first electrode layer and the element; providing a mask member on a portion of the insulating layer; forming a through-hole in another portion of the insulating layer and then providing a second electrode layer over the mask member and a portion of the first electrode layer that is exposed through the through-hole; and removing the mask member to form a space between the second electrode layer and the insulating layer.

A method of manufacturing a substrate according to the present invention includes preparing a base plate including an element, a first electrode layer disposed in contact with the element, and an insulating layer extending over the first electrode layer and the element; providing a mask member made of resin on a first portion of the insulating layer; and forming a through-hole in another portion of the insulating layer and then providing a second electrode layer over the mask member and a portion of the first electrode layer that is exposed through the through-hole.

Further features of the present invention will become apparent from the following description of exemplary embodiments with reference to the attached drawings.

DESCRIPTION OF THE EMBODIMENTS

Figure 1:
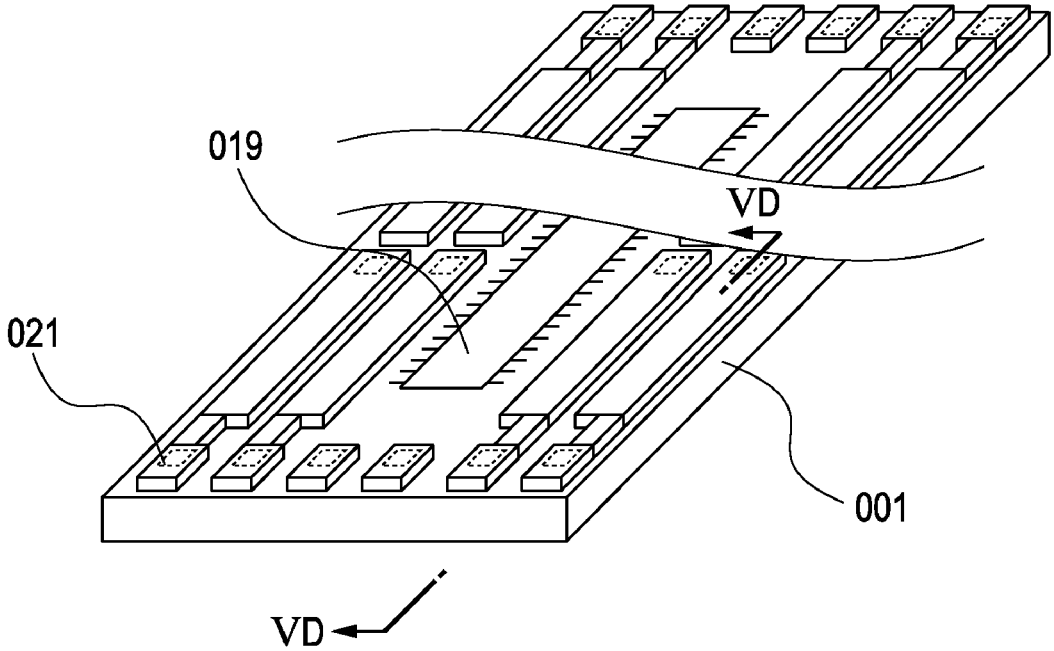
FIG. 1 is a schematic view of a substrate, according to a first embodiment of the present invention, for liquid ejection heads.
Figure 8A:
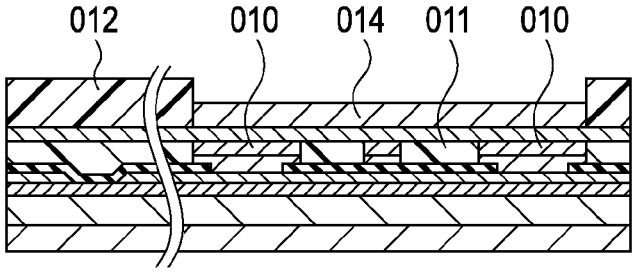
FIGS. 8A to 8F are schematic sectional views illustrating steps of the method according to the fourth embodiment.
Figure 8B:
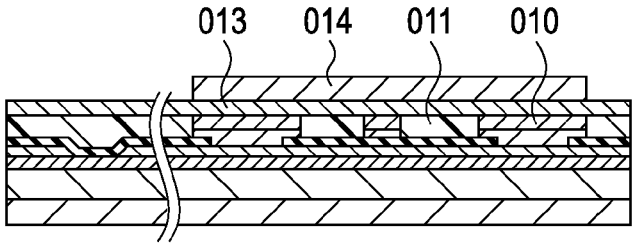
Figure 8C:
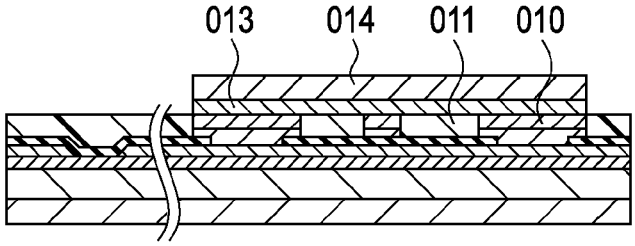
Figure 8D:
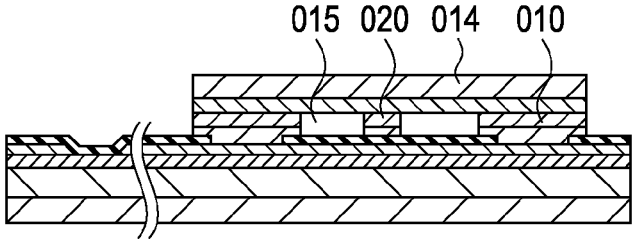
Figure 8E:
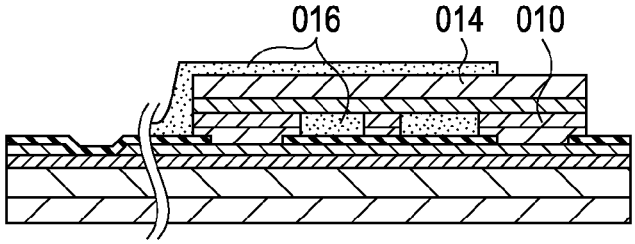
Figure 8F:
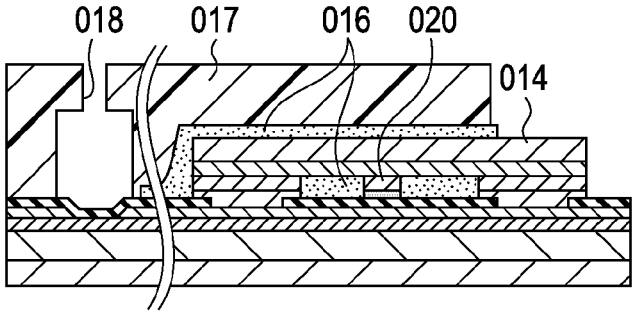
Figure 12:
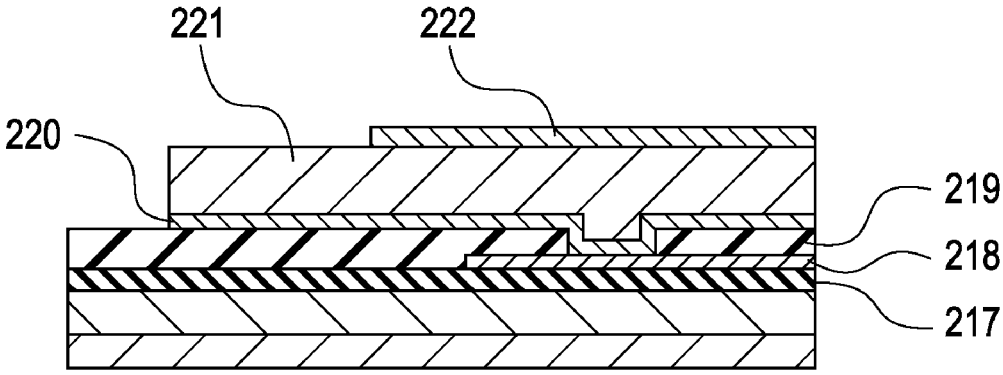
FIG. 12 is a sectional view of the liquid ejection head taken along the line XII-XII of FIG. 11.

FIG. 1 is a schematic view of a substrate 001, according to a first embodiment of the present invention, for liquid ejection heads. The substrate 001 includes a supply port 019 for supplying ink and electrode pads 021. The difference between the substrate 001 and that shown in FIG. 12 is a configuration in cross section taken along the line VD-VD of FIG. 1. As shown in FIGS. 5D and 8D which are schematic sectional views taken along the line VD-VD of FIG. 1, each space 015 is present between the substrate 001 and a second electrode layer.

The space 015 is filled with an organic resin or a mask member.

Figure 2:
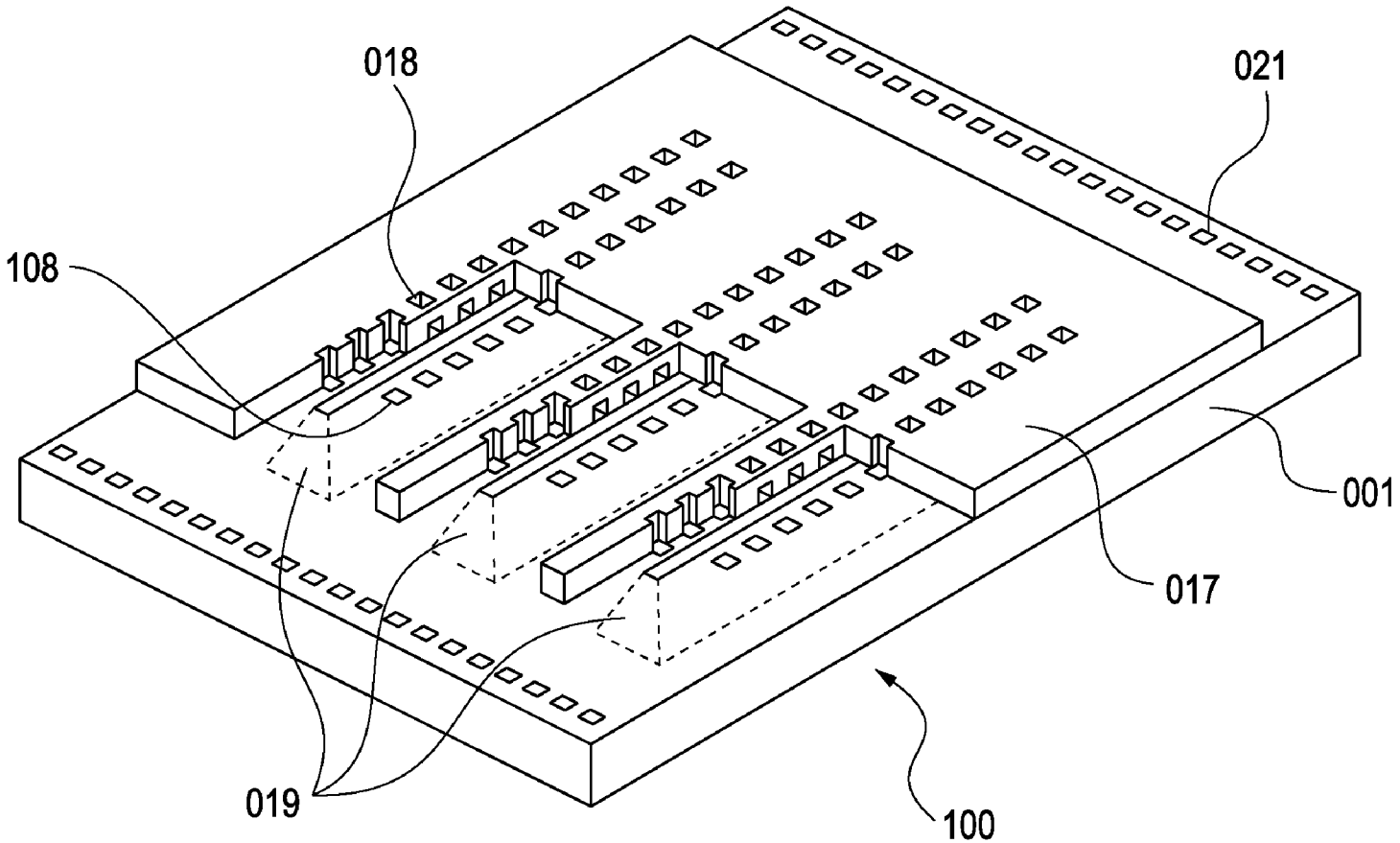
FIG. 2 is a schematic perspective view of a liquid ejection head according to a second embodiment of the present invention.

FIG. 2 is a schematic perspective view of a liquid ejection head 100 according to a second embodiment of the present invention. The liquid ejection head 100 includes the substrate 001 shown in FIG. 1 and a passage member 017 including recessed portions for forming walls of passages connected to discharge ports 018 for ejecting a liquid. The passage member 017 is bonded to the substrate 001 with the recessed portions inside. The substrate 001 may include a plurality of supply ports 019 for supplying ink. This allows the supply ports 019 to be supplied with different inks. A plurality of energy-generating elements 108 generating thermal energy used to eject a liquid are arranged on both sides of each supply port 019 in the longitudinal direction of the supply port 019. The energy-generating elements 108 each include a heat-generating resistor layer made of a high-resistance material and a pair of electrode layers (first electrode layers 004) supplying electric power to a corresponding one of the energy-generating elements 108.

The first electrode layers 004 are made of a low-resistance material such as aluminum (Al) so as to supply electric power to the energy-generating elements 108. The first electrode layers 004 are supplied with electric power from second electrode layers 014. In this embodiment, the second electrode layers 014 are made of gold. A procedure for forming the first and second electrode layers 004 and 014 and the space 015 are described below.

FIGS. 3 to 5 are schematic sectional views illustrating steps of a method of manufacturing a liquid ejection head according to a third embodiment of the present invention.

Figure 3A:
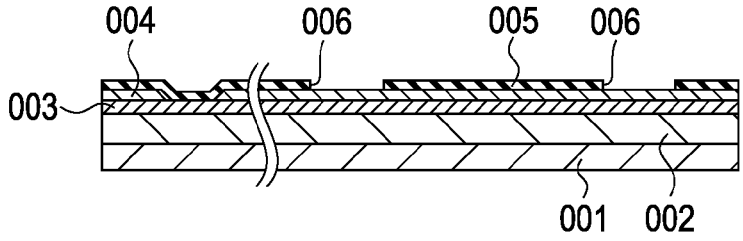
FIGS. 3A to 3F are schematic sectional views illustrating steps of a method of manufacturing a liquid ejection head according to a third embodiment of the present invention.
Figure 3B:
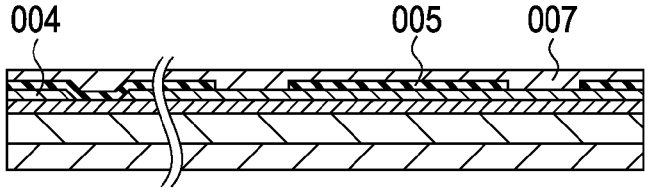
Figure 3C:
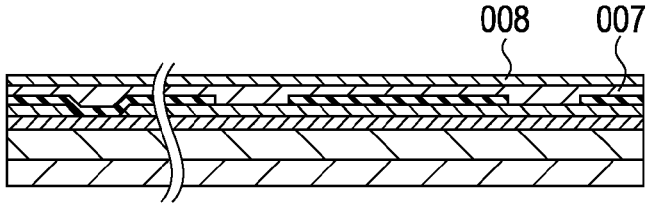
Figure 3D:
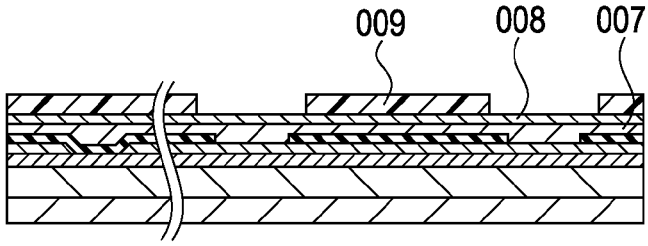
Figure 3E:
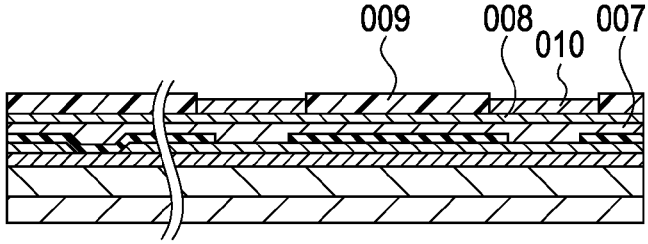
Figure 3F:
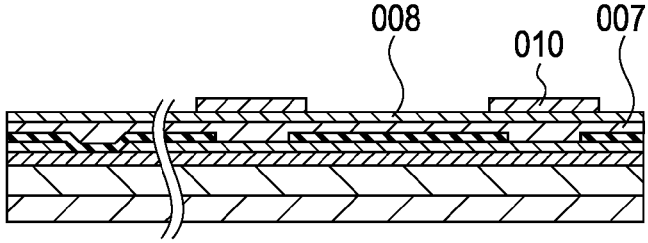

As shown in FIG. 3A, a heat storage layer 002 made of silicon dioxide ($SiO_2$) and a heat-generating resistor layer 003 made of tantalum silicon nitride (TaSiN) are provided on a silicon plate 001 in that order. First electrode layers 004 made of aluminum (Al) and an insulating layer (protective layer) 005 made of silicon nitride (SiN) are provided on the heat-generating resistor layer 003 such that the insulating layer 005 extends over the first electrode layers 004. These layers are formed by a plasma-enhanced vacuum deposition process or a similar process. The insulating layer 005 is patterned by photolithography, whereby through-holes (openings) 006 for electrically connecting the first electrode layers 004 to gold electrode interconnects that are second electrode layers are formed in the insulating layer 005. Therefore, the gold electrode interconnects (second electrode layers) contact through the insulating layer 005 with the first electrode layers 004. This allows electric power supplied from the gold electrode interconnects (second electrode layers) to the heat-generating resistor layer 003 through the first electrode layers 004 to be converted into heat with the heat-generating resistor layer 003. As shown in FIG. 3B, a titanium-tungsten layer 007 is formed over the insulating layer 005 with a vacuum deposition system or the like so as to have a predetermined thickness. The titanium-tungsten layer 007 serves as a diffusion-preventing layer and contains, for example, a refractory metal material. As shown in FIG. 3C, a first gold underlayer 008 is formed over the titanium-tungsten layer 007 with a vacuum deposition system or the like so as to have a predetermined thickness. The first gold underlayer 008 is used to form portions of the second electrode layers. As shown in FIG. 3D, a photoresist layer 009 is provided on the first gold underlayer 008 by a coating process, exposed to light, and then developed, whereby openings are photolithographically formed in the photoresist layer 009 so as to be located at positions where first gold platings 010 are to be formed. The photoresist layer 009 has a thickness greater than that of the first gold platings 010. As shown in FIG. 3E, the first gold platings 010 are deposited on predetermined regions used to form portions of the second electrode layers by an electroplating process in such a manner that a predetermined current is applied to the first gold underlayer 008 in an electrolytic solution containing gold sulfite. As shown in FIG. 3F, the photoresist layer 009 is dissolved off in such a manner that the photoresist layer 009 is immersed in a stripping solution for a predetermined time.

Figure 4A:
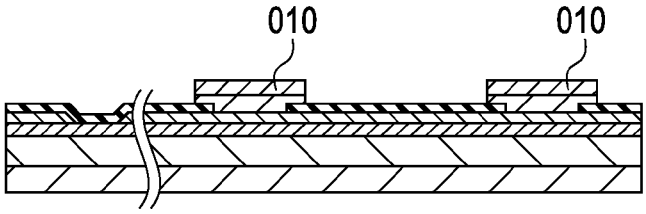
FIGS. 4A to 4F are schematic sectional views illustrating steps of the method according to the third embodiment.
Figure 4B:
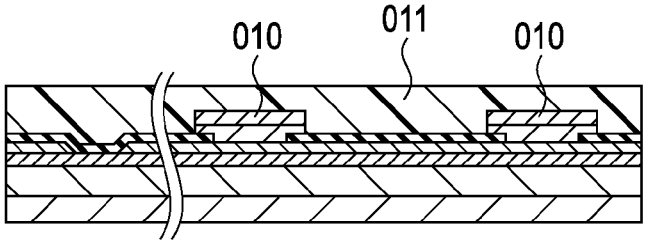
Figure 4C:
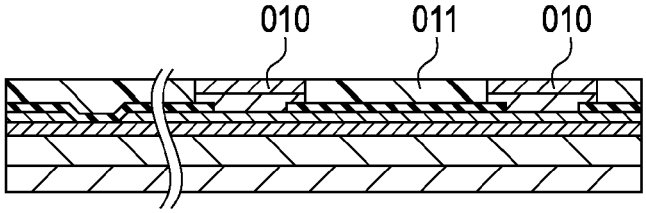
Figure 4D:
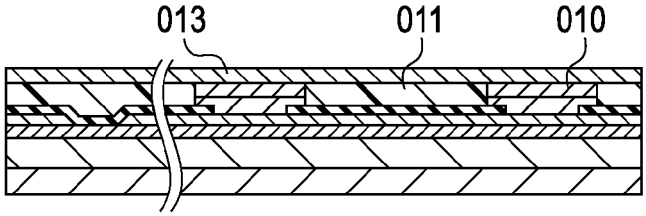
Figure 4E:
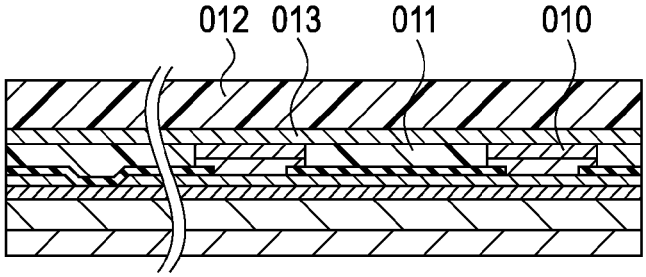
Figure 4F:
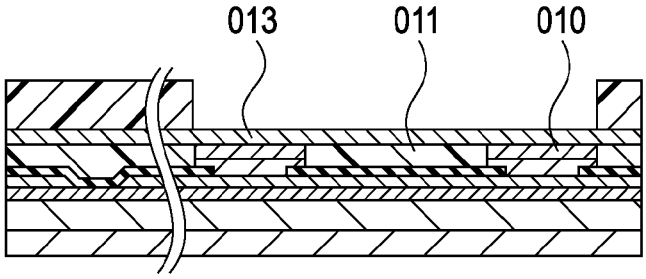

As shown in FIG. 4A, the first gold underlayer 008 and the titanium-tungsten layer 007 are partly etched off using the first gold platings 010 as a mask. Although the first gold platings 010 are etched when the first gold underlayer 008 is etched, the first gold platings 010 remain above the silicon plate 001 because the first gold platings 010 have a large thickness. As shown in FIG. 4B, a resist layer (mask member) 011 for forming second gold platings 014 is formed over the first gold platings 010 using the same resist as that used to form the first gold platings 010. The resist layer 011 has a thickness greater than that of the first gold platings 010. The reason for using the same resist to form the first and second gold platings 010 and 014 is that a plurality of stripping solutions need not be used. As shown in FIG. 4C, the resist layer 011 is partly etched off by a dry etching process using gas containing oxygen and the like until surface portions of the first gold platings 010 are uncovered. This allows spaces between the first gold platings 010 to be filled with the resist. As shown in FIG. 4D, a second gold underlayer 013 is formed over the first gold platings 010 with a vacuum deposition system or the like so as to have a predetermined thickness. The second gold underlayer 013 is also used to form portions of the second electrode layers. As shown in FIG. 4E, a second gold plating-use resist layer 012 is formed over the second gold underlayer 013 by a spin coating process. As shown in FIG. 4F, openings are photolithographically formed in the second gold plating-use resist layer 012 so as to be located at positions where the second gold platings 014 are to be formed in such a manner that the second gold plating-use resist layer 012 is exposed to light and then developed.

Figure 5A:
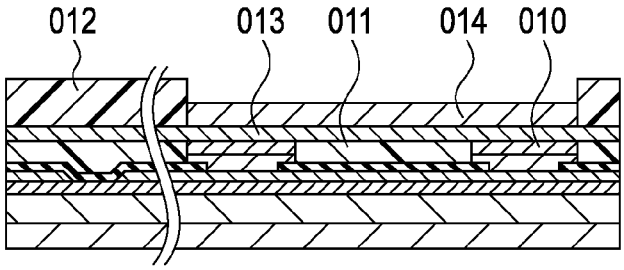
FIGS. 5A to 5F are schematic sectional views illustrating steps of the method according to the third embodiment.
Figure 5B:
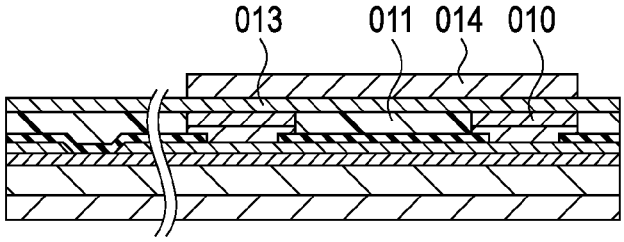
Figure 5C:
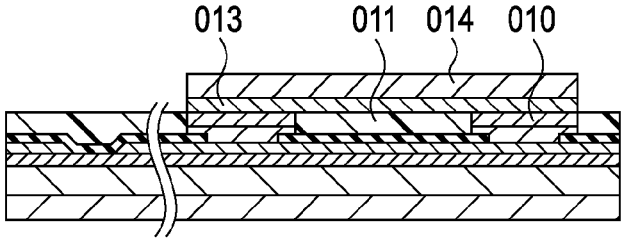
Figure 5D:
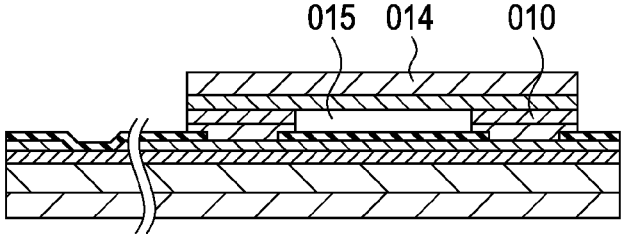

As shown in FIG. 5A, the second gold platings 014 are deposited in the openings formed in the second gold plating-use resist layer 012 by an electroplating process in such a manner that a predetermined current is applied to the second gold underlayer 013 in an electrolytic solution containing gold sulfite. The second gold platings 014 are portions of the second electrode layers. As shown in FIG. 5B, the second gold plating-use resist layer 012 is dissolved off in such a manner that the second gold plating-use resist layer 012 is immersed in the stripping solution for a predetermined time, whereby the second gold underlayer 013 is uncovered. As shown in FIG. 5C, unnecessary portions of the second gold underlayer 013 are removed using the second electrode layers 014 as a mask in such a manner that the second gold underlayer 013 is immersed in an aqueous solution containing an organic nitrogen compound and iodine-potassium iodide for a predetermined time. This allows the second electrode layers, which include the stacked gold platings, to be formed. As shown in FIG. 5D, the resist layer 011, which is a mask member, is removed in such a manner that the resist layer 011 is immersed in the stripping solution for a predetermined time, whereby spaces 015 are formed between the insulating layer 005 and the second electrode layers. Gold electrodes are usually formed above substrates and therefore if protective layers disposed on the substrates have defects, the gold electrodes are shorted with the substrates because of the defects. In this embodiment, the spaces 015 are present; hence, short circuits can be prevented.

Figure 5E:
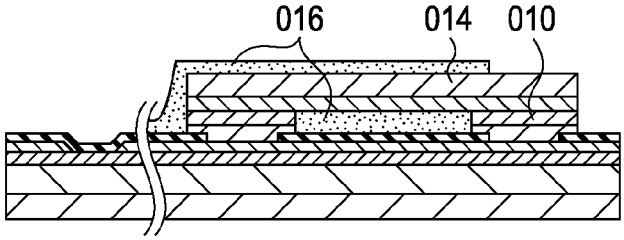

A substrate for liquid ejection heads is prepared as described above. As shown in FIG. 5E, an adhesive layer 016 which ensures the adhesion between the substrate and a liquid passage member and which insulates the second electrode layers from ink is provided on the substrate. The adhesive layer 016 is a member (first resin-made member) made of resin. The adhesive layer 016 may be made of, for example, an organic resin such as a polyether amide resin. The adhesive layer 016 is formed by applying such a resin to the substrate by a spin coating process and a pattern is formed by photolithography so as to be located at a predetermined position.

Members (second resin-made members) made of the resin used to form the adhesive layer 016 may be provided in the spaces 015, which are present between the insulating layer 005 and the second electrode layers. Since the spaces 015 are filled with the resin, the substrate can be prevented from being shorted with the second electrode layers. In this embodiment, the adhesive layer 016 (first resin-made member) and the resin (second resin-made members) packed in the spaces 015 are identical in composition to each other and therefore can be formed at the same time. This allows the number of manufacturing steps to be reduced.

Figure 5F:
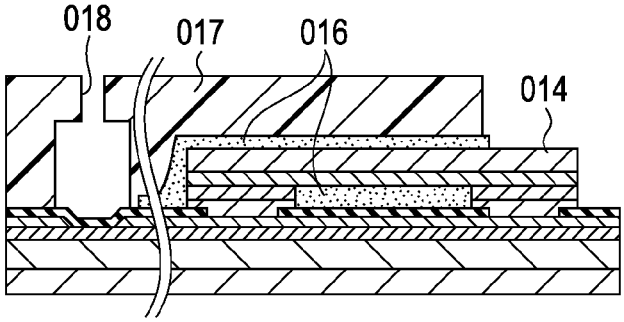

As shown in FIG. 5F, discharge ports 018 are photolithographically formed in such a manner that a layer of an organic resin 017 for forming a passage member (nozzle member) is provided on the adhesive layer 016 by a spin coating process so as to have an arbitrary thickness, exposed to light, and then developed, whereby the liquid ejection head can be obtained.

The resin-made members are provided between the insulating layer 005 and the second electrode layers or provided in the spaces 015 as described above; hence, short circuits can be prevented and therefore the reliability of the layers included in the substrate can be enhanced. This results in the enhancement of the reliability of the liquid ejection head.

As is clear from the comparison between FIGS. 5D and 8D, this embodiment is different from the third embodiment in that a pillar 020 for preventing distortion is present in each of spaces 015.

The increase of substrate size to 0.86 inch or more causes the distortion of gold electrode interconnects 014. The pillars 020 have a function of preventing the distortion of gold electrode interconnects 014. The pillars 020 are formed in the spaces 015 in a first gold plating step so as not to be electrically connected to a substrate.

This embodiment will now be described with reference to FIGS. 6 to 8. The same components as those described in the third embodiment will not be described in detail.

Figure 6A:
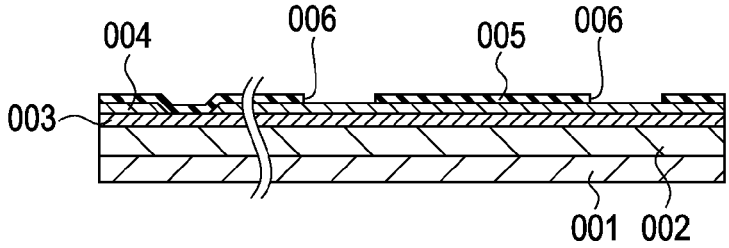
FIGS. 6A to 6F are schematic sectional views illustrating steps of a method of manufacturing a liquid ejection head according to a fourth embodiment of the present invention.
Figure 6B:
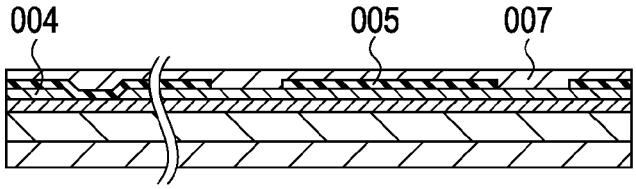
Figure 6C:
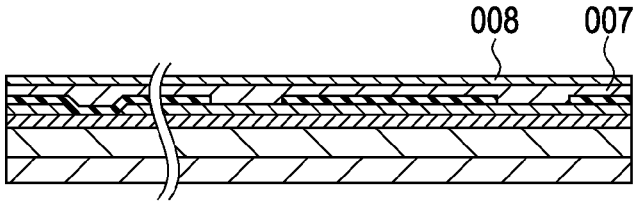
Figure 6D:
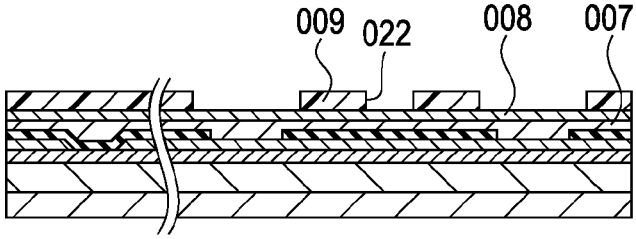

FIGS. 6A to 6C correspond to FIGS. 3A to 3C, which are referenced in the third embodiment. FIG. 6D corresponds to FIG. 3D, which is referenced in the third embodiment. The application, exposure, and development of a photoresist 009 are performed by photolithography, whereby openings are formed at positions where first gold platings are formed. In a protective layer 005 that is an insulating layer overlying the substrate, the photoresist 009 is formed in a region containing no through-holes (open portions) 006 connecting first electrodes to second electrodes. The pitch between positions where open portions 022 are formed is preferably less than 0.86 inch and the size thereof is preferably one-half or more of the width of the gold electrode interconnects.

Figure 6E:
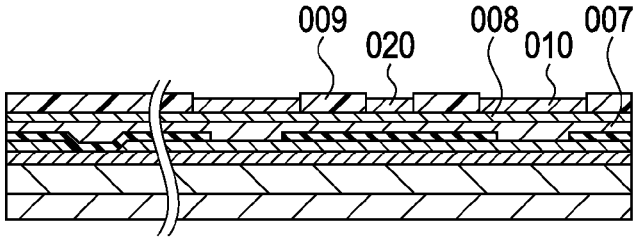
Figure 6F:
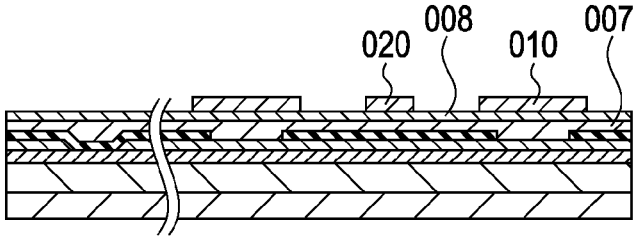
Figure 7A:
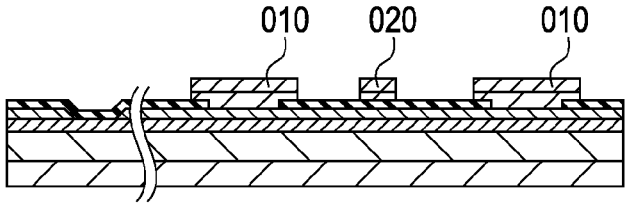
FIGS. 7A to 7F are schematic sectional views illustrating steps of the method according to the fourth embodiment.
Figure 7B:
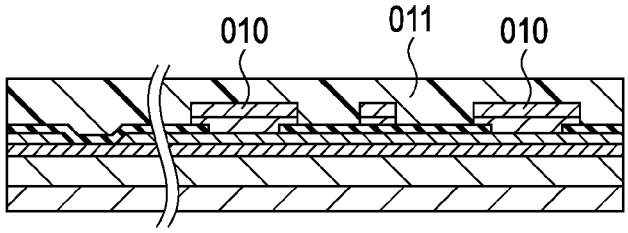
Figure 7C:
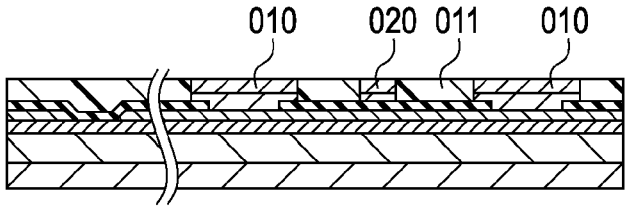
Figure 7D:
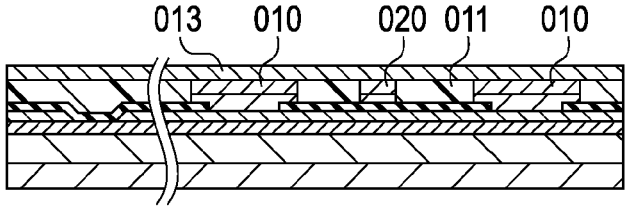
Figure 7E:
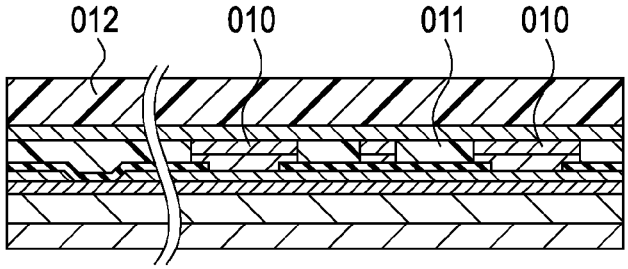
Figure 7F:
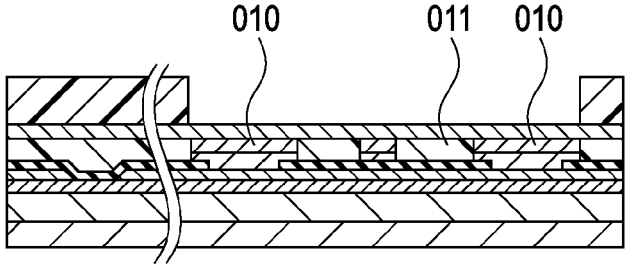

FIG. 6E corresponds to FIG. 3E, which is referenced in the third embodiment. Gold platings 020 are formed in the open portions 022, which are present in the photoresist 009 and are not directly electrically connected to the substrate. FIG. 6F corresponds to FIG. 3F, which is referenced in the third embodiment. FIG. 7A corresponds to FIG. 4A, which is referenced in the third embodiment. As shown in FIG. 7A, the pillars 020 are formed by gold plating together with first gold platings 010 so as not to be electrically connected to the substrate. FIG. 7B corresponds to FIG. 4B, which is referenced in the third embodiment. FIG. 7C corresponds to FIG. 4C, which is referenced in the third embodiment. A resist 011 is etched until surface layers of the first gold platings 010 and those of the pillars 020. In particular, the resist 011 is etched by a dry etching process using gas containing oxygen and the like. FIGS. 7D to 7F correspond to FIGS. 4D to 4F, which are referenced in the third embodiment. FIGS. 8A to 8F correspond to FIGS. 5A to 5F, which are referenced in the third embodiment.

According to such a configuration and method, the pillars 020 serve as beams in an elongated head. Therefore, there is an advantage that the distortion of long gold electrodes, which may be caused by the warpage of a substrate, is prevented.

In the third and fourth embodiments, the resists 011 in the spaces 015 are removed in the steps shown in FIGS. 5D and 8D in such a manner that the resists 011 are immersed in the stripping solutions. In this embodiment, a resist 011 (first resin-made member) that is a member made of resin is provided in spaces 015 instead of the organic resin, such as a polyether amide resin, described in the third embodiment.

Figure 9:
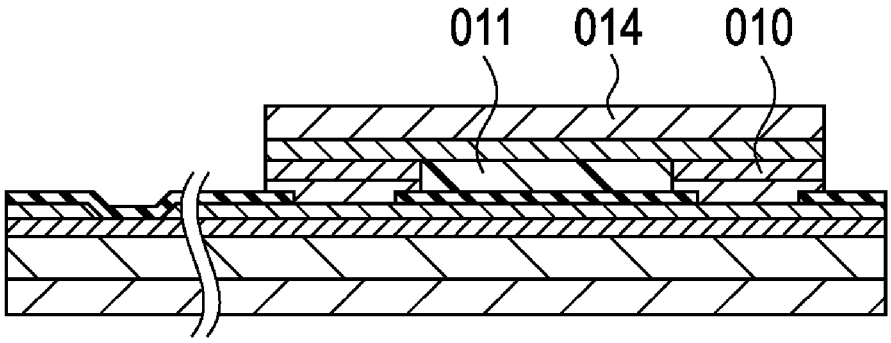
FIG. 9 is a schematic sectional view illustrating a method of manufacturing a liquid ejection head according to a fifth embodiment of the present invention.
Figure 10:
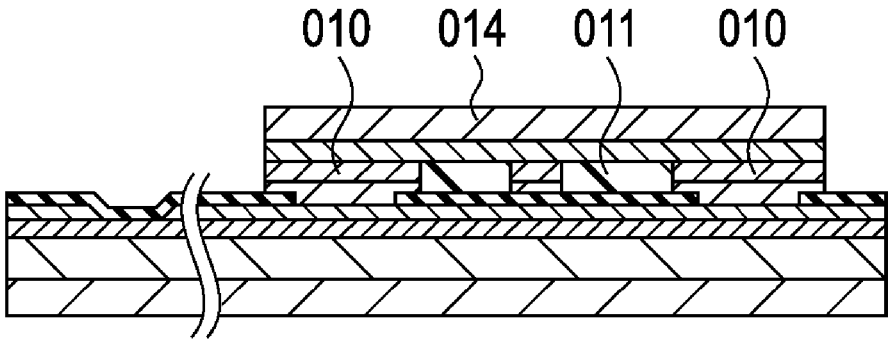
FIG. 10 is a schematic sectional view illustrating the method according to the fifth embodiment.
Figure 11:
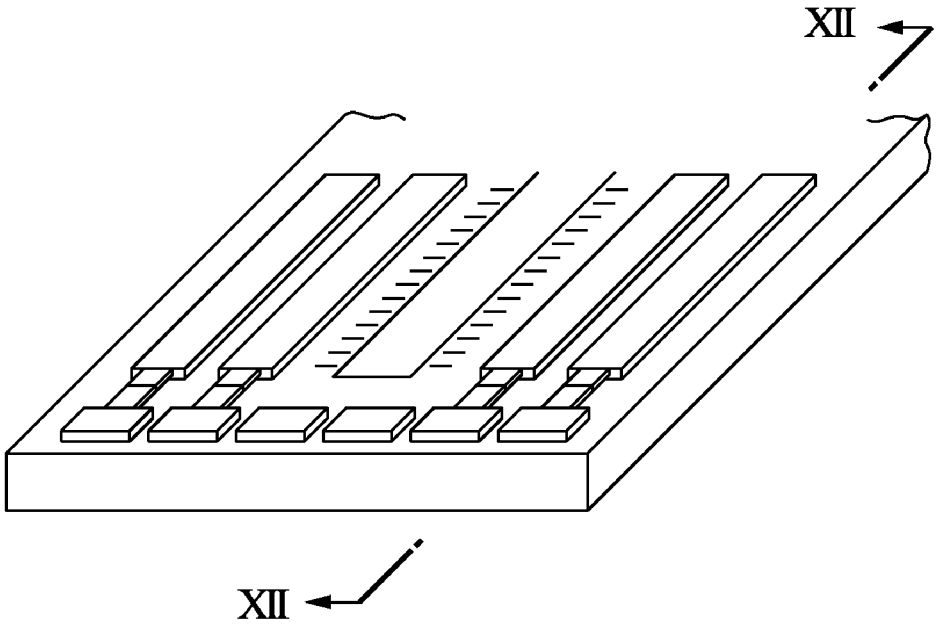
FIG. 11 is a perspective view of a conventional liquid ejection head.

FIG. 9 shows a state after the step shown in FIG. 5C, which is referenced in the third embodiment. FIG. 10 shows a state after the step shown in FIG. 8C, which is referenced in the fourth embodiment. Unnecessary portions of the resist 011 are stripped off by a dry etching process using gas containing oxygen and the like in such a manner that a surface of a substrate is irradiated with plasma for a predetermined etching time depending on the thickness of the resist 011. This allows portions of the resist 011 corresponding to the spaces 015 shown in FIGS. 5 and 8 to remain.

In the third or fourth embodiment, if the electrode layers are designed to have a large width or the routing of the electrode layers is complicated, the fluidity of a polyether amide resin for forming an adhesive layer 016 may be probably unsatisfactory. In this case, this embodiment allows portions of the resist 011, which can increase the insulation between the substrate and gold electrodes, to remain in regions corresponding to the spaces 015 in forming the gold electrodes.

The polyether amide resin for forming the adhesive layer 016 (second resin-made member), which has high adhesion with a passage member and serves as an insulating layer, is applied to the gold electrodes, which are second electrode layers, by a spin coating process. The adhesive layer 016 is patterned by photolithography such that a portion of the adhesive layer 016 remains in a region to be tightly bonded to the passage member.

An organic resin 017 corresponding to the passage member is applied to the adhesive layer 016 by a spin coating process so as to form a layer with an arbitrary thickness. Discharge ports 018 are photolithographically formed in such a manner that this layer is exposed to light and then developed, whereby an inkjet recording head can be obtained.

According to such a configuration and method, even if the routing of gold electrodes formed above a substrate is complicated, spaces between a protective layer disposed above the substrate and the gold electrodes can be stably filled with a mask member 011. Therefore, an inkjet recording head with high reliability can be obtained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-318565 filed Dec. 15, 2008, which is hereby incorporated by reference herein in its entirety.

What is claimed is:

1. A substrate for a liquid ejection head, comprising:
an element generating energy used to eject a liquid;
a first electrode disposed in contact with the element;
an insulating layer extending over the first electrode and the element; and
a second electrode including a first portion provided at a position corresponding to an opening, which is formed on the insulating layer, for electrically connecting the second electrode with the first electrode and a second portion positioned differently from that of the first portion in the direction perpendicular to a thickness direction of the insulating layer and which is not in contact with the insulating layer, the second electrode being positioned differently from that of the first electrode in the thickness direction,
wherein a space is formed between the second portion and the insulating layer.

2. The substrate according to claim 1, wherein the second electrode is made of gold.

3. A liquid ejection head comprising:
the substrate according to claim 1; and
a passage member having walls surrounding a passage communicatively connected to a discharge port ejecting a liquid and which forms the passage together with the substrate in such a way that the passage member is in contact with the substrate with the walls inside.

4. A substrate for a liquid ejection head, comprising:
an element generating energy used to eject a liquid;
a first electrode disposed in contact with the element;
an insulating layer extending over the first electrode and the element; and
a second electrode including a first portion provided at a position corresponding to an opening, which is formed on the insulating layer, for electrically connecting the second electrode with the first electrode and a second portion positioned differently from that of the first portion in the direction perpendicular to a thickness direction of the insulating layer and which is not in contact with the insulating layer, the second electrode being positioned differently from that of the first electrode in the thickness direction,
wherein a resin is disposed between the second portion and the insulating layer.

5. The substrate according to claim 4, wherein the second electrode is made of gold.

6. A liquid ejection head comprising:
the substrate according to claim 4; and
a passage member having walls surrounding a passage communicatively connected to a discharge port ejecting a liquid and which forms the passage together with the substrate in such a way that the passage member is in contact with the substrate with the walls inside.

7. The liquid ejection head according to claim 6, further comprising a resin layer increasing adhesion between the substrate and the passage member, the resin layer being disposed between the substrate and the passage member.

8. The liquid ejection head according to claim 7, wherein the resin disposed between the second portion and the insulating layer and the resin layer are made of the same compositional material.

* * * * *